United States Patent [19]

Ohashi et al.

[11] Patent Number: 4,618,554

[45] Date of Patent: Oct. 21, 1986

[54] ELECTROPHOTOGRAPHIC PHOTORECEPTOR HAVING PHOTOSENSITIVE LAYER MADE OF A PHTHALOCYANINE TREATED WITH AN ACRYLIC RESIN

[75] Inventors: Masato Ohashi; Motohiko Kashioka, both of Toda; Shinichi Tamura, Tokyo; Hiromitsu Katsura, Tokorozawa; Hideaki Ueda, Kawanishi; Akihiro Nakamura, Toyonaka, all of Japan

[73] Assignees: Toyo Ink Mfg. Co., Ltd., Tokyo; Minolta Camera Kabushiki Kaisha, Osaka, both of Japan

[21] Appl. No.: 715,985

[22] Filed: Mar. 26, 1985

[30] Foreign Application Priority Data

Mar. 30, 1984 [JP] Japan ..... 59-60866

[51] Int. Cl.[4] ..... G03G 5/06

[52] U.S. Cl. ..... 430/78; 430/135

[58] Field of Search ..... 430/49, 56, 78, 135

[56] References Cited

U.S. PATENT DOCUMENTS 3,455,889 7/1969 Coleman ..... 260/80.72
3,816,118 6/1974 Byrne ..... 430/78
4,443,528 4/1984 Tamura et al. ..... 430/56
4,520,088 5/1985 Senga et al. ..... 430/114

*Primary Examiner*—John L. Goodrow
*Attorney, Agent, or Firm*—Watson, Cole, Grindle & Watson

[57] ABSTRACT

An electrophotographic photoreceptor which has excellent electrophotographic characteristics even when exposed to high-temperature and high-humidity conditions is formed from a phthalocyanine which has been treated with an acrylic resin, the acrylic resin having been obtained by polymerization of not less than 15 mole % of a monomer represented by the general formula,

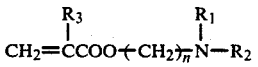

wherein $R_1$ and $R_2$ independently represent a hydrogen atom or an alkyl, aryl or cycloalkyl group, or $R_1$ and $R_2$, taken together, may form a heterocyclic-ring containing a nitrogen atom, $R_3$ represents a hydrogen atom or methyl group, and n represents an integer of 1 or more, or an acid salt of the monomer.

6 Claims, No Drawings

ELECTROPHOTOGRAPHIC PHOTORECEPTOR HAVING PHOTOSENSITIVE LAYER MADE OF A PHTHALOCYANINE TREATED WITH AN ACRYLIC RESIN

BACKGROUND OF THE INVENTION

There are two basic electrophotographic processes, the xerographic process and the electrofax process. In the former process, a photoreceptor, formed by applying a thin film of photoconductors such as selenium, cadmium sulfide and the like onto a metallic drum, is charged in the dark place and irradiated with a photoimage (exposing) to form an electrostatic latent image. From this latent image, a visible image is formed with a toner (developing) which is transferred to paper, etc., and fixed. In the latter process, a photoconductive layer (photosensitive layer) is applied onto paper, and a permanent visible image is formed on this layer through the steps of charging, exposing, developing and fixing.

As the photoconductor for electrophotographic photoreceptors now widely used, there are known inorganic compounds such as amorphous selenium, cadmium sulfide, zinc oxide, etc., and organic compounds such as polyvinylcarbazole (PVK), phthalocyanine, azo compounds, etc.

The organic photoconductor is superior in flexibility and processability, but it is not sufficient in electrophotographic sensitivity when applied alone for practical uses. This sensitivity is increased by applying chemical sensitization and optical sensitization in combination. The well-known chemical sensitizer includes for example, polycyclic or heterocyclic nitro compounds such as 2,4,7-trinitro-9-fluorenone (TNF), 2,4,5,7-tetranitro-9-fluorenone (TENF), etc., quinones such as anthraquinone, etc., and nitrile compounds such as tetracyanoethylene, etc. Also, the well-known optical sensitizer includes xanthene dyes and quinoline pigments.

Among the organic photoconductors, the phthalocyanine photoconductor gives excellent electrophotographic photoreceptors, but it has a defect in that, when exposed to severe environments, for example to high temperatures above 40° C. high humidities above 80%, the phthalocyanine electrophotographic photoreceptor shows a great reduction in chargeability or a great deterioration in the electrostatic characteristics on repeated uses. As described above, the physical property of the photoreceptor changes greatly due to changes in the environment, so that the use of the photoreceptor sometimes causes a problem.

SUMMARY OF THE INVENTION

The present invention provides an electrophotographic photoreceptor characterized in that phthalocyanine treated with an acrylic resin is used, the resin being obtained by polymerization of not less than 15 mole % of a monomer represented by the general formula, $$CH_2{=}\overset{\overset{R_3}{|}}{C}COO{+}CH_2{\rangle}_n\overset{\overset{R_1}{|}}{N}{-}R_2$$

wherein $R_1$ and $R_2$ independently represent a hydrogen atom or an alkyl, aryl or cycloalkyl group, or $R_1$ and $R_2$, taken together, may form a heterocyclic-ring containing a nitrogen atom, $R_3$ represents a hydrogen atom or a methyl group, and n represents an integer of 1 or more, or an acid salt of the monomer.

The photoreceptor of the present invention, even if used under severe conditions or a change in environment, is superior in electrophotographic characteristics such as photosensitivity and image quality stability on repeated uses, and also it is superior in terms of sanitation.

DETAILED EXPLANATION OF THE INVENTION

The present invention relates to an electrophotographic photoreceptor having a photosensitive layer comprising a binding resin and phthalocyanine dispersed therein, wherein the phthalocyanine is treated with an acrylic resin, the resin being obtained by polymerization of not less than 15 mole % of a monomer represented by the general formula (I), $$CH_2{-}\overset{\overset{R_3}{|}}{C}COO{+}CH_2{\rangle}_n\overset{\overset{R_1}{|}}{N}{-}R_2 \qquad (I)$$

wherein $R_1$ and $R_2$ independently represent a hydrogen atom or an alkyl, aryl or cycloalkyl group, or $R_1$ and $R_2$, taken together, may form a heterocyclic-ring containing a nitrogen atom, $R_3$ represents a hydrogen atom or methyl group, and n represents an integer of 1 or more, or an acid salt of the monomer.

According to the present invention, there is provided an electrophotographic photoreceptor containing phthalocyanines superior in terms of sanitation, which is superior in photosensitivity and stability with the lapse of time as well as in the sensitivity stability on repeated uses even under severe temperature and humidity conditions, and useful in industry.

Phthalocyanine used in the present invention may be any of phthalocyanines which act as a photoconductive element, and it includes metal-free phthalocyanine, metal phthalocyanines and mixtures thereof. The metal of metal phthalocyanines includes copper, silver, beryllium, magnesium, calcium, zinc, cadmium, barium, mercury, aluminium, gallium, indium, lanthanum, neodymium, samarium, europium, gadolinium, dysprosium, holmium, sodium, lithium, ytterbium, lutetium, titanium, tin, hafnium, lead, thorium, vanadium, antimony, chromium, molybdenum, uranium, manganese, iron, cobalt, nickel, rhodium, palladium, osmium, platinum and the like. Also, the central nucleus of phthalocyanine is not a metal atom, but may be halogenated metal having a trivalence or more. Of these, metal-free phthalocyanine and metal phthalocyanines containing copper, cobalt, lead, zinc, etc., at the nucleus are preferred. Phthalocyanines of low degree of halogenation may also be used. Phthalocyanine is a well-known compound as pigment, and phthalocyanine produced by any process may be used in the present invention. The well-known crystal form of phthalocyanine, for example, $\alpha$-, $\beta$-, $\gamma$-, $\delta$-, $\epsilon$- and X-forms, etc., may be used.

The production of phthalocynine photoconductors is described in Japanese Patent Publication No. 2780/1965, Japanese Patent Application Kokai (Laid-open). No. 59136/1974, and U.S. Pat. No. 4,443,528. However, the phthalocyanine of the present invention is not limited to ones produced by these methods. The phthalocyanine derivative used in these methods is synthesized using as a starting material phthalonitrile, phthalic acid, phthalic acid anhydride or phthalimide having a substituent at the benzene nucleus. The substituent may be introduced into phthalocyanine after synthesis of the phthalocyanine. The phthalocyanine of the phthalocyanine derivative includes metal-free phthalocyanine and metal phthalocyanines containing copper, iron, cobalt, nickel, magnesium, calcium, sodium, lithium, aluminum or the like at the nucleus.

The acrylic resin according to the present invention is one obtained by polymerizing 15 to 100 mole % of a monomer represented by the general formula (I) or its acid salt with 85 to 0 mole % of other polymerizable monomers. This acrylic resin is generally soluble in acid aqueous solutions, but insoluble in neutral or alkali aqueous solutions. This acrylic resin is colorless.

As the monomer represented by the foregoing general formula (I), there are given the mono- or dimethylaminoethyl ester of acrylic or methacrylic acid, mono- or diethylaminoethyl ester of the noted acid, mono- or di-n-propylaminoethyl ester of the noted acid, tert-butylaminoethyl ester of the noted acid, mono- or dicyclohexylaminoethyl ester of the noted acid, piperidinoethyl ester of the acid salts thereof.

As other polymerizable monomers, there are given for example alkyl esters of acrylic or methacrylic acid, hydroxyalkyl esters of the noted acid, acrylamides, sodium salt of sulfopropyl methacrylate, polypropylene glycol monomethacrylate, styrene, α-methylstyrene, vinyl ketone, vinyl acetate, vinyl propionate and the like.

For treatment of phthalocyanine with the acrylic resin, an acid aqueous solution of the acrylic resin is added to an aqueous slurry of phthalocyanine, and after stirring the mixture uniformly, an alkali such as ammonia or alkali hydroxide is added to make the mixture neutral or alkaline. Phthalocyanine may be treated with an emulsion of the acrylic resin. In the treatment above, the amount of the acrylic resin used for covering phthalocyanine is 0.5 to 50 wt. %, preferably 1 to 30 wt. % based on 100 parts by weight of the phthalocyanine.

When the photoconductive material obtained by the foregoing treatment is formulated into a paint together with a binding resin, the paint obtained shows a good fluidity such as a low viscosity, little tendency to show structural viscosity, etc. Further, being non-flocculative, it has excellent storage stability. In addition, it is very advantageous in industry that the electrophotographic photoreceptor obtained from this photoconductive material has good electrophotographic characteristics. The electrophotographic characteristics such as photosensitivity, stability of sensitivity on repeated uses, etc., of this photoreceptor make it possible to obtain the same degree of photosensitivity as in photoconductive materials such as cadmium sulfide, etc., as well as higher light fastness than in the materials.

The photoconductive material of the present invention may be used alone for forming a photoconductive layer together with a binding resin, etc. In some cases, it may be used in combination with other phthalocyanine photoconductive materials, other photoconductive materials and common sensitizers.

Also, in using the photoconductive material of the present invention in combination with a compound such as hydrazones, oxadiazoles, triphenylmethanes, pyrazolones, styrils, etc., known as a charge transfer material, the photoconductive material and the compound may be used in mixture, in a single layer, or in multi-layers having different functions.

Further, 0.01 to 30 parts by weight of an antioxidant may be used, if necessary, in combination with 100 parts by weight of phthalocyanine.

In order to use the photoconductive material of the present invention as an electrophotographic photoreceptor, the material is uniformly dispersed together with a binding resin, a solvent, etc., on kneading/dispersing apparatus such as ball mills, attritors, etc., and coated onto an electroconductive support to form a photosensitive layer. The electrophotographic photoreceptor produced with the photoconductive material of the present invention includes not only electrophotographic photoreceptors comprising the photosensitive layer alone according to the present invention, but also electrophotographic photoreceptors comprising a laminated film of said photosensitive layer, a barrier layer, an insulating layer and a photosensitive layer containing other photoconductive materials.

The binding resin used in the present invention may be selected one or more of binding resins, of which the insulation property, expressed by volume resistivity, is $10^7$ Ωcm or more, consisting of melamine resins, epoxy resins, silicon resins, polyurethane resins, polyester resins, acrylic resins, xylene resins, vinyl chloride/vinyl acetate copolymeric resins, polycarbonate resins, cellulose derivatives and the like.

This photoconductive material is applied to electroconductive supports generally used for electrophotographic photoreceptors by coating techniques, etc., to form a photosensitive layer. The electroconductive supports include for example sheet-form or cylinder-form ones made of aluminum plate, electroconduction-treated paper, plastic film or the like. For coating the electroconductive supports, the viscosity of the photoconductive material is properly regulated if necessary by adding a solvent, and the resulting coating liquor is applied onto the supports by means of air doctor coater, blade coater, rod-coater, reverse-roll coater, spray coater, hot coater, squeeze coater or the like to form a coating film. After coating, the photosensitive layer formed is properly dried until it acquires sufficient charged potential enough to act as a photosensitive layer.

In the photoreceptor according to the present invention, the weight ratio of resin to photoconductive element is generally 1 or more, and therefore, as compared with, for example, photoreceptors with zinc oxide, the photoreceptor of the present invention is large in the resin content and the physical strength of the film, and rich inflexibility. In addition, the photoreceptor of the present invention has excellent characteristics in practical use, for example, large band strength between the coating film and the electroconductive support; excellent resistance to temperature and humidity; little change with the lapse of time; no toxicity; easy production; low cost and the like.

In using the electrophotographic photoreceptor produced with the photoconductive material of the present invention, laser ray may also be used as a light source in addition to the commonly used halogen lamps.

The present invention will be illustrated with reference to the following examples. In the examples, part is represented by weight.

EXAMPLE 1

(a) Production of acrylic resin solution:

To a four-necked flask were added 243 parts of isopropyl alcohol and 2.4 parts of azobisisobutyronitrile, and the mixture was heated to 80° C. while passing a nitrogen gas. A mixture comprising 86 parts of methyl acrylate and 157 parts of dimethylaminoethyl methacrylate was then added dropwise, and 2.4 parts of azobisisobutyronitrile was then added while continuing heating. At the point when the conversion reached 95% or more, the reaction mixture was cooled to 50° C. or less, and a mixture of 100 parts of a 37% hydrochloric acid and 537 parts of water was added. The resin solution obtained was transferred to a distillation flask, and 95% of isopropyl alcohol used above was distilled out of the flask. The resin solution obtained had a solid content of 27% and a pH of 2.1.

(b) Treatment of phthalocyanine:

Ten parts of copper phthalocyanine and 0.2 part of tetranitro-copper phthalocyanine were acid-pasted with sulfuric acid to obtain 100 parts of an aqueous paste containing 10 parts of α-form copper phthalocyanine. Ten parts of the above resin solution (a) was added to 100 parts of the aqueous paste, and after heating the mixture to 90° C., the pH of the mixture was adjusted to 9 with a dilute aqueous ammonia solution. After stirring for about 1 hour, the mixture was filtered, washed until the filtrate become neutral and dried.

(c) Production of electrophotographic photoreceptor:

| | part |
|---|---|
| Copper phthalocyanine (b) | 1 |
| Diethylaminobenzaldehyde diphenylhydrazone | 3 |
| Acrylic polyol (Takelac A-702; produced by Takeda Chemical Industries, Ltd) | 3.6 |
| Epoxy resin (Epon 1007, produced by Shell Chemical Co.) | 0.5 |
| Xylene | 1.2 |
| Cellosolve acetate | 1.2 |

The mixture was kneaded for 48 hours on a porcelain ball mill to obtain a photoconductive composition. The storage stability of this composition was good without changes such as flocculation, etc., even after the lapse of three months.

The electrophotographic characteristics of this composition was examined as follows: This composition was roll-coated onto the aluminum surface of a laminated film comprising aluminum foil of 5 microns thick and polyester film of 75 microns thick so that the dry film thickness was 8 microns, and placed for 1 hour in an oven uniformly kept at 110° C. to obtain an electrophotographic photoreceptor. The photoreceptor thus obtained was placed in varying environments, and corona discharge was applied thereto under the condition that a voltage be +5.7 KV, a corona gap be 10 mm and a charging speed be 10 m/min. Ten seconds after stopping the discharge, the photoreceptor was exposed to a tungsten light source of 2854° K. with an illuminance of 10 Lux. The sensitivity of a photoreceptor was defined as a quantity of light applied required for the potential just before the exposure to lower by 50%. On measuring the maximum surface charge potential, rate of dark-decay in percent, sensitivity and residual potential of the sample, both the chargeability and sensitivity showed satisfactory values for practical use as can be seen from the result in the following table.

| Environmental condition | Maximum surface charge potential (V) | Percent dark-decay (%) | Sensitivity (lux. sec.) | Residual potential (V) |
|---|---|---|---|---|
| 40° C. 85% | 570 | 10 | 1.0 | 10 |
| 20° C. 85% | 605 | 8 | 1.2 | 10 |

Note:
The upper figure in the column of environmental condition shows a temperature and the lower one a humidity.

A change in the photosensitivity of this sample was measured by repeating a cycle of charging and exposing, and as a result, it was found that this sample was a photoreceptor having excellent repetition stability, showing a value comparable to that of cadmium sulfide photoreceptors. The above photoreceptor was positively charged, exposed to white light through a test pattern of positive image and developed with a negatively charged developing toner, and as a result, images which were faithful to the test pattern as well as clear and superior in contrast were obtained with an exposure amount of 1 to 1.5 Lux sec in every case.

COMPARATIVE EXAMPLE 1

In the preparation of a photoconductive composition in Example 1, the same was prepared using an untreated α-form phthalocyanine and tested in the same manner as in Example 1. As a result, it was found that the same result as in Example 1 was obtained in a condition of 20° C.×10–85% humidity, but that the maximum surface potential lowered to 200 V in a condition of more than 40° C. × more than 85% in humidity, becoming a problem in terms of practical use.

EXAMPLES 2 AND 3

In Example 1, photoreceptors were produced by varying phthalocyanine used in (b) as follows:

Acid-pasted crude copper phthalocyanine (Example 2)

ε-Form copper phthalocyanine (Example 3) and tested in the same manner as in Example 1. As a result, good results similar to Example 1 were obtained.

EXAMPLE 4

In the same manner as in (a) of Example 1, a mixture of 610 parts of methanol and 3.3 parts of benzoyl peroxide was heated, and a mixture comprising 52 parts of styrene, 244 parts of diethylaminoethyl methacrylate hydrochloride and 40 parts of ethyl acrylate was added dropwise thereto. Thereafter, the reaction mixture was treated in the same manner as in (a) of Example 1 to obtain a resin solution having a solid content of 21%.

As phthalocyanine, α-form copper phthalocyanine, β-form one and ε-form one were treated and used.

Photoconductive composition were prepared from the following:

| | part |
|---|---|
| One of the treated phthalocyanine | 10 |
| 2,2-methylenebis(4-ethyl-6-tert-butylphenol) | 0.5 |
| Polyester resin (Vylon RV-200; produced by Toyobo Co., Ltd.) | 50 |
| Tetrahydrofuran | 20 |

-continued

| | part |
|---|---|
| Toluene | 20 |

From these compositions, electrophotographic photoreceptors were prepared in the same manner as in Example 1 and tested. As a result, every phthalocyanine gave a good result as shown in the following table.

| Environmental condition | Maximum surface charge potential (V) | Percent dark-decay (%) | Sensitivity (lux. sec.) | Residual potential (V) |
|---|---|---|---|---|
| 40° C. | 590 | 9 | 6.2 | 20 |
| 85% | 580 | 10 | 6.4 | 25 |
| | 580 | 9 | 6.1 | 25 |
| 20° C. | 600 | 7 | 6.3 | 25 |
| 85% | 600 | 8 | 6.5 | 20 |
| | 605 | 8 | 6.3 | 25 |

Note:
In the above table, the numerical values at the upper, middle and lower parts show the measurement results with α-form, β-form, and ε-form phthalocyanines, respectively.

What is claimed is:

1. An electrophotographic photoreceptor having a photosensitive layer comprising a binding resin and phthalocyanine dispersed therein, wherein the phthalocyanine has been treated with an acrylic resin in an amount of 0.5 to 50 parts by weight of acrylic resin based on 100 parts by weight of phthalocyanine; said acrylic resin having been obtained by polymerization of not less than 15 mole % of a monomer represented by the general formula (I),

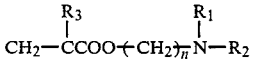

(I)

wherein $R_1$ and $R_2$ independently represent a hydrogen atom or an alkyl, aryl or cycloalkyl group, or $R_1$ and $R_2$, taken together, may form a heterocyclic-ring containing a nitrogen atom, $R_3$ represents a hydrogen atom or methyl group, and n represents an integer of 1 or more, or an acid salt of the monomer.

2. An electrophotographic photoreceptor as described in claim 1, wherein a monomer represented by the general formula (I) is selected from the group consisting of the mono- or dimethylaminoethyl ester of acrylic or methacrylic acid, mono- or diethylaminoethyl ester of said acid, mono- or di-n-propylaminoethyl ester of said acid, tert-butyl-aminoethyl ester of said acid, mono- or dicyclohexylaminoethyl ester of said acid, piperidinoethyl ester of said acid and acid salts thereof.

3. An electrophotographic photoreceptor as described in claim 1 wherein the treatment of phthalocyanine with the acrylic resin is carried out by adding an aqueous slurry of phthalocyanine to an acid aqueous solution of the acrylic resin, and then making the resulting mixture neutral or alkaline.

4. An electrophotographic photoreceptor as described in claim 1, wherein the acrylic resin is produced from 15 to 100 mole % of the monomer represented by the general formula (I) or the acid salt thereof and 85 to 0 mole % of another polymerizable monomer.

5. An electrophotographic photoreceptor as described in claim 1, wherein the acrylic resin is soluble in acid aqueous solution, but insoluble in alkaline aqueous solution.

6. An electrophotographic photoreceptor having a photosensitive layer, said electrophotographic photoreceptor being formed by the steps of (1) providing a substrate, (2) polymerizing not less than 15 mole % of a monomer represented by the general formula (I),

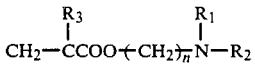

(I)

wherein $R_1$ and $R_2$ independently represent a hydrogen atom or an alkyl, aryl or cycloalkyl group, or $R_1$ and $R_2$, taken together, may form a heterocyclic-ring containing a nitrogen atom, $R_3$ represents a hydrogen atom or methyl group, and n represents an integer of 1 or more, or an acid salt of the monomer, thereby forming an acrylic resin, (3) treating a phthalocyanine compound with the acrylic resin obtained in step (2), the amount of acrylic resin used ranging from 0.5 to 50 parts by weight based on 100 parts by weight of the phthalocyanine compound, (4) dispersing the treated phthalocyanine compound obtained in step (3) with a binding resin to form a photoconductive composition, and (5) applying a layer of the photoconductive composition obtained in step (4) to said substrate provided in step (1), thus providing said electrophotographic photoreceptor having a photosensitive layer.

* * * * *